US008003554B2

(12) United States Patent
Saeger et al.

(10) Patent No.: US 8,003,554 B2
(45) Date of Patent: Aug. 23, 2011

(54) CLOTHING SUPPORT FOR A CARD FLAT COVERING

(75) Inventors: Nicole Saeger, Aachen (DE); Thomas Kämper, Burgwedel (DE); Ute Pöhler, Wedemark (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 490 days.

(21) Appl. No.: 11/727,046

(22) Filed: Mar. 23, 2007

(65) Prior Publication Data

US 2007/0238385 A1 Oct. 11, 2007

(30) Foreign Application Priority Data

Apr. 7, 2006 (DE) ..... 10 2006 016 832

(51) Int. Cl.

| | |
|---|---|
| ***B32B 27/12*** | (2006.01) |
| ***B32B 27/02*** | (2006.01) |
| ***B32B 27/04*** | (2006.01) |
| ***B32B 27/06*** | (2006.01) |
| ***B32B 27/30*** | (2006.01) |
| ***B32B 27/40*** | (2006.01) |

(52) U.S. Cl. ..... 442/394; 442/148; 442/149; 442/164; 442/381; 442/402

(58) Field of Classification Search ..... 442/148, 442/149, 164, 381, 394, 402
See application file for complete search history.

(56) References Cited

U.S. PATENT DOCUMENTS

| | | | | |
|---|---|---|---|---|
| 3,290,729 | A | 12/1966 | Maynard | |
| 3,947,922 | A * | 4/1976 | Ibbotson | 19/114 |
| 4,100,006 | A * | 7/1978 | Buckley | 156/78 |
| 4,221,023 | A * | 9/1980 | Henderson et al. | 19/113 |
| 4,356,598 | A * | 11/1982 | Graf | 19/114 |
| 4,594,284 | A * | 6/1986 | Nakagawa et al. | 442/214 |
| 5,073,428 | A * | 12/1991 | Lancelot et al. | 428/67 |
| 6,101,849 | A * | 8/2000 | Pernick | 66/141 |
| 6,436,240 | B1 * | 8/2002 | Jeffrey | 162/358.2 |
| 2004/0214489 | A1 * | 10/2004 | Porter | 442/36 |

FOREIGN PATENT DOCUMENTS

| | | |
|---|---|---|
| DE | 21 33 929 A | 7/1971 |
| DE | 7327334 U | 7/1974 |
| DE | 24 47 470 A1 | 4/1975 |
| DE | 29 21 535 C2 | 10/1980 |
| GB | 309986 | 1/1929 |
| GB | 362041 | 12/1931 |

(Continued)

OTHER PUBLICATIONS

German Search Report for Application No. 10 2006 016 832.1 (and Partial Translation).

(Continued)

*Primary Examiner* — Andrew T Piziali
(74) *Attorney, Agent, or Firm* — Venable LLP; Robert Kinberg; Steven J. Schwarz

(57) ABSTRACT

In a clothing support for a card flat covering, the belt-shaped support is made of plastics material, and there is embedded in a base body at least one reinforcing insert which is also belt-shaped and which is arranged in the vicinity of the back of the support. In order to make possible stronger anchoring by simple means and to allow undisrupted oscillation of clothing wires, the base body has at least two layers (bottom layer and top layer) of different plastics materials connected to one another, and the bottom layer incorporates a fabric.

12 Claims, 4 Drawing Sheets

FOREIGN PATENT DOCUMENTS

| | | |
|---|---|---|
| GB | 1 282 998 | 7/1972 |
| GB | 1 405 621 | 9/1975 |
| GB | 1 521 001 | 8/1978 |
| GB | 2 142 572 | 1/1985 |
| JP | 59-228024 | 12/1984 |
| JP | 61-226333 | 10/1986 |

OTHER PUBLICATIONS

British Search Report, dated Aug. 3, 2007, issued on British Application No. GB0706643.4.

* cited by examiner

CLOTHING SUPPORT FOR A CARD FLAT COVERING

CROSS REFERENCE TO RELATED APPLICATION

This application claims priority from German Patent Application No. 10 2006 016 832.1 dated Apr. 7, 2006, the entire disclosure of which is incorporated herein by reference.

BACKGROUND OF THE INVENTION

The invention relates to a clothing support for a card flat covering.

A known clothing support, which may be belt-shaped, is made of plastics material, there being embedded in a base body at least one reinforcing insert which is also belt-shaped and which is arranged in the vicinity of the back of the support.

In practice, flexible clothings are used in the main for the flats of carding machines. These clothings comprise small hooks which are set into resilient, multi-ply fabric layers and are made of round or oval wire bent into a U shape and provided with a knee, bending when subjected to loading and returning to their original position when no longer loaded. The basis therefor (clothing support) is formed loaded. The basis therefor (clothing support) is formed by a plurality of cotton fabric layers, frequently in combination with rubber layers, in the form of a continuous narrow (51 mm) or wide (as wide as the flat is long) belt, into which there are pushed small double hooks made of round or oval wire, the legs being provided with a knee and the base having a connecting bridge. A knee is necessary so that the hook does not stand up too high on bending back and so that it is possible to operate with small spacings between the clothings. In order to increase the grip of the clothing, the sides of the tips are usually tapered by grinding (lateral grinding). In addition, they are hardened. The density of occupation on the flat is, for example, 240-500 tips per square inch. Inter alia, the clothing support should be dimensionally stable in order to avoid undesirable bulging during operation and, therefore, impairment of the carding nip; it should have sufficient strength to ensure that the clothing wires are anchored when subjected to the carding forces, should have a certain resilience in order to allow yielding and springing back of the clothing wires and should have low resistance to being pierced.

A known clothing support (DE-A-29 21 535) consists of a base body of resilient solid-plastics material, for example of polyvinyl chloride or polyurethane with appropriate plasticisers. Embedded in the base body—in one case close to the upper side and in the other case close to the back of the support—are reinforcing inserts comprising fabric layers, which are also made of plastics material, for example polyester. The clothing wires are anchored in the base body. They are held, on the one hand, by the resilient base body material and, on the other hand, in the mesh interstices of the fabrics. The base body consists entirely of a resilient plastics material. The resilience is necessary so that the clothing wires can oscillate inside and outside the base body. On the other hand, the resilience impairs the firm anchoring of the clothing wires, so that two reinforcing fabrics are necessary in the base body, in the mesh interstices of which fabrics the clothing wires are held. It is disadvantageous that, for the purpose of anchoring, a reinforcing fabric is also arranged in the vicinity of the upper side of the support, which considerably impairs the oscillations of the clothing wires inside the base body in the central region and in the vicinity of the upper side of the support and outside the support. The clothing wires can even buckle, which leads to disruptions in production.

SUMMARY OF THE INVENTION

It is an aim of the invention to provide a clothing support of the kind described at the beginning that avoids or mitigates the mentioned disadvantages and that especially makes possible stronger anchoring by simple means and allows undisrupted oscillation of the clothing wires.

The invention provides a clothing support for a card flat covering, comprising at least first and second elongate layers of plastics materials connected to one another, wherein said first layer incorporates a reinforcing insert comprising a fabric.

The measures in accordance with the invention make it possible to achieve stronger anchoring by simple means and to accomplish clothing wire oscillation without any disruptive impairment. As a result of the fact that the base body consists of at least two layers, that is to say of at least a first, bottom layer in the region of the back and a second, top layer in the region of the upper side, a separation of functions is elegantly achieved so that the strong anchoring is accomplished by the bottom layer, and the undisrupted oscillation by the top layer. In order to fulfil those functions, the bottom layer and the top layer are made of different plastics materials. The firm anchoring of the clothing wires in the bottom layer is promoted by the fact that the clothing wires are deflected less in the fabric layer. Anchoring is reinforced even further as a result of the fact that the reinforcing insert is present in the bottom layer. The resistance to being pierced is advantageously reduced as a result of the fact that the nonwoven does not have crossing points. Finally, the clothing support according to the invention makes possible improved product quality at reduced cost and allows reproducible quality (identical product properties). The quality of the clothing support (card flat material quality) is optimally matched to the loads on the flat during carding and those occurring during manufacture of the clothing support.

In one embodiment, the bottom layer incorporates a nonwoven, for example, the first layer may be of a polyester nonwoven, which may, for example, be latex-impregnated. In one preferred embodiment, the first layer, which in practice is at or near the back of the support, is made up of at least two superimposed fabric portions impregnated with latex to form said first layer. Where used in the invention, a nonwoven fabric is advantageously consolidated, for example, mechanically, by through-stitching, adhesively, by heat treatment, or by needling.

In one exemplary embodiment the top layer is made of polyurethane. In that case, the polyurethane layer may be about 0.1 to 0.3 mm thick. The polyurethane layer may have a Shore A hardness of about 50 to 70, preferably 60.

In some preferred embodiments, between the bottom layer and the top layer there is arranged at least one middle layer. The middle layer(s) may be formed by a synthetic polymeric material, for example, a thermoplastic material. In a preferred embodiment, the middle layer is made of polyvinyl chloride. The polyvinyl chloride is advantageously used with addition of plasticisers. The polyvinyl chloride layer is, for example, about 0.0.6 to 1.0 mm, preferably 0.8 mm, thick. The polyvinyl chloride layer has, for example, a Shore A hardness of about 50 to 70, preferably 66.

In certain embodiments, two reinforcing fabrics extend through the bottom layer. In one advantageous embodiment, a polyester fabric is used as reinforcing fabric, for example, a polyester fabric comprising fibres of dtex about 110/dtex about 1100. It may be found advantageous in some cases for a coating to be present on the top layer, for example, a coating of a surface-coating composition. Illustrative of suitable surface-coating compositions are those having a low coefficient of friction, for example, about 0.18, against steel. The coating advantageously forms an anti-adhesion surface. In certain embodiments, the support has a thickness of about 3.0 to 3.4 mm, preferably 3.2 mm. In other embodiment, the support may have a thickness of less than 3.0 mm, preferably less than 2.0 mm. In one embodiments, low-elongation, high-strength polyester fabrics are used. The fabric may be, for example, a filament fabric. Other suitable reinforcements include a woven fabric, or a knit. A second reinforcement fabric, where present, for example, a nonwoven fabric, a woven fabric or a knit, may be present as a part of a nonwoven structure forming a reinforcement layer or may provide an additional reinforcement layer. If desired, the layers may have an adhesion-promoting, for example roughened or the like, surface. In certain embodiments, the rear sides of the layers are provided with activatable adhesive. The first and second layers are advantageously of different plastics materials. For the avoidance of doubt, reference in that context to "different" plastics materials includes reference to two entirely different polymer materials or to two different grades of a given polymer, having different properties.

The invention also provides a clothing strip for a card flat covering, wherein the belt-shaped support is made of plastics material, there being embedded in a base body at least one reinforcing insert which is also belt-shaped and which is arranged in the vicinity of the back of the support, and clothing wires being inserted and anchored in the support, wherein the clothing support has at least two layers, at least a bottom layer and a top layer of different plastics materials connected to one another, and the bottom layer is made from a nonwoven. In preferred forms of clothing strip, a top element may be arranged on the support, for example, a top element consisting of a sheet metal strip, especially steel band. It is preferred for the top element and the support to be connected to one another, for example, to be adhesively bonded to one another.

The invention also provides a flat having a card flat covering, wherein the belt-shaped support is made of plastics material, there being embedded in a base body at least one reinforcing insert which is also belt-shaped and which is arranged in the vicinity of the back of the support, and clothing wires being inserted and anchored in the support, wherein the clothing support has at least two layers, at least a bottom layer and a top layer of different plastics materials connected to one another, and the bottom layer is made from a nonwoven.

The present invention also provides a clothing support for a card flat covering, wherein the belt-shaped support is made of plastics material, there being embedded in a base body at least one reinforcing insert which is also belt-shaped and which is arranged in the vicinity of the back of the support, wherein the clothing support has at least two layers (bottom layer and top layer) of different plastics materials connected to one another, and the bottom layer is made of a nonwoven.

DETAILED DESCRIPTION OF CERTAIN PREFERRED EMBODIMENTS

Figure 1:
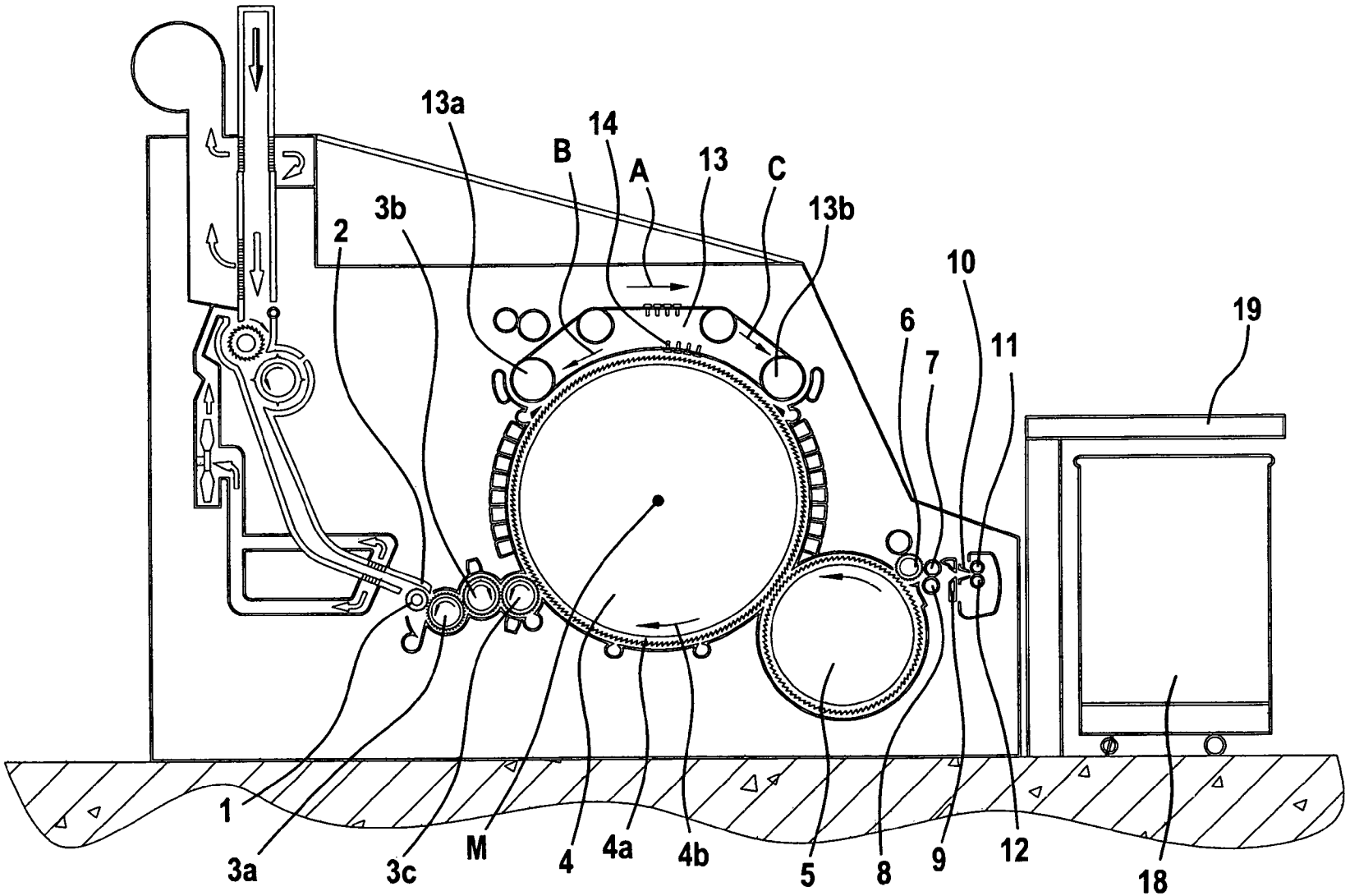
FIG. 1 is a diagrammatic side view of a flat card having flats, clothing supports and clothing strips in accordance with the invention.

With reference to FIG. 1, a flat card, for example a TC 03 flat card made by Trützschler GmbH & Co. KG of Mönchengladbach, Germany, has a feed roller 1, feed table 2, lickers-in 3*a*, 3*b*, 3*c*, cylinder 4, doffer 5, stripper roller 6, nip rollers 7, 8, web-guiding element 9, web funnel 10, delivery rollers 11, 12, revolving card top 13 having card top guide rollers 13*a*, 13*b* and flats 14, can 18 and can coiler 19. The directions of rotation of the rollers are indicated by curved arrows. Reference letter M denotes the centre (axis) of the cylinder 4. Reference numeral 4*a* denotes the clothing and reference numeral 4*b* denotes the direction of rotation of the cylinder 4. The arrow A indicates the working direction. Arrow B denotes the running direction of the flats 14 in the carding location and arrow C denotes the return transport direction of the flats 14. The curved arrows drawn inside the rollers denote the directions of rotation of the rollers.

Figure 2:
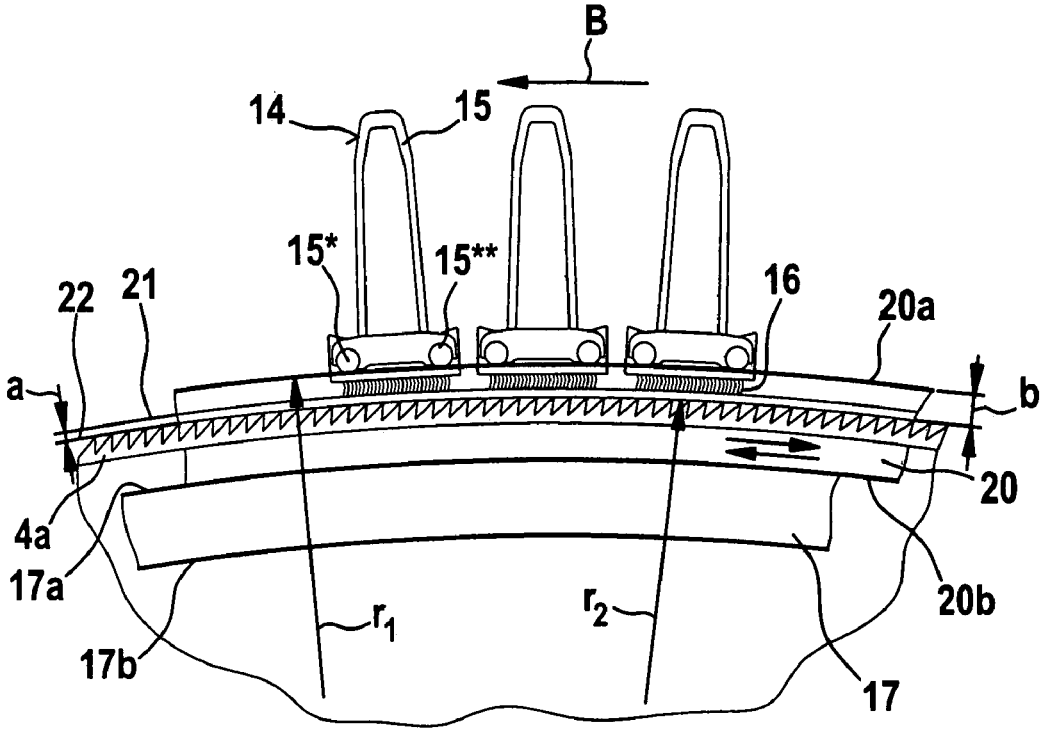
FIG. 2 shows flats of a revolving card top and part of the first slideway of a two-sided slideway.

In accordance with FIG. 2, on each side of the flat card, a flexible bend 17 having several adjustment screws is fixed laterally to the frame of the machine using screws. The flexible bend 17 has a convex outer surface 17*a* and an underside 17*b*. On top of the flexible bend 17 there is a first slideway 20, for example made of low-friction plastics material, which has a convex outer surface 20*a* and a concave inner surface 20*b*. The second slideway (on the other side of the machine) is not shown. The concave inner surface 20*b* rests on top of the convex outer surface 17*a*. The card flats 14 have, at each of their two ends, a card flat head, in which there are mounted in an axial direction two steel pins 14*a*, 14*b*, which slide on the convex outer surface 20*a* of the slideway 20 in the direction of arrow B. The card flat clothing 16 is mounted on the underside of the carrier member 15. Reference numeral 21 denotes the circle of tips at the closest position of the card flat clothings 16. The cylinder 4 has on its circumference a cylinder clothing 4*a*, for example a sawtooth clothing. Reference numeral 22 denotes the circle of the tips of the cylinder clothing 4*a*. The spacing between the circle of tips 21 and the circle of tips 22 is denoted by reference letter a and is, for example, 0.20 mm. The spacing between the convex outer surface 20*a* and the circle of tips 22 is denoted by reference letter b. The radius of the convex outer surface 20*a* is denoted by reference letter $r_1$ and the radius of the circle of tips 22 is denoted by reference letter $r_2$. The radii $r_1$ and $r_2$ intersect at the centre point M (see FIG. 1) of the cylinder 4. At least some and preferably all of the card flats of the revolving card top of FIGS. 1 and 2 incorporate a clothing support according to the present invention.

Figure 3:
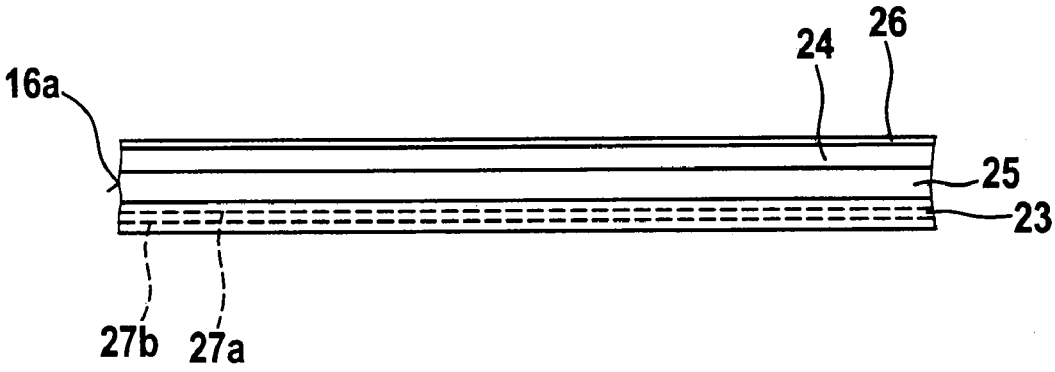
FIG. 3 is a longitudinal section through part of a clothing support.

An illustrative embodiment of the clothing support of the invention is shown in FIG. 3. The clothing support 16*a* shown in FIG. 3 has three layers 23, 25, 24, which are arranged one above another and connected to one another. Between a first, bottom, layer 23 and a second, top, layer 24 there is located a third, middle layer 25. Arranged on the top layer is a thin coating 26. In the bottom layer 23 there are provided, parallel to one another, two reinforcing fabrics 27*a*, 27*b* (tension-carrying fabrics) of low thickness. It is possible to produce the layers 23, 24, 25 using a very great variety of thickness values in order to match them to particular requirements.

The structure of one clothing support according to the invention is given hereinbelow by way of example only, but the invention is not to be limited thereto.

Bottom layer 23: Latex-impregnated polyester nonwoven with 2 layers of polyester tension-carrying fabrics 6/2 dtex110/dtex1100

Middle layer 25: Polyvinyl chloride, about 0.8 mm thick, Shore A about 66

Top layer 24: Polyvinyl chloride, about 0.2 mm thick, Shore A about 60

Coating 26: Surface-coating composition having a low coefficient of friction—about 0.18 against steel The thickness c of the clothing support 16*a* is variable, for example as a result of varying the thickness d of the bottom layer 23 (nonwoven layer) or modifying the thickness f of the middle layer 25 or the thickness e of the top layer 24. The thickness of more than one, or all, of the layers may be varied. The thickness c can be, for example, 3.2 mm. However, for example in the case of clothings 16*b* of lower height, it can also be produced in a thickness of less than 3.2 mm, in order, for example, to reduce the costs for the clothing support 16*a* (card flat material).

Figure 4A:
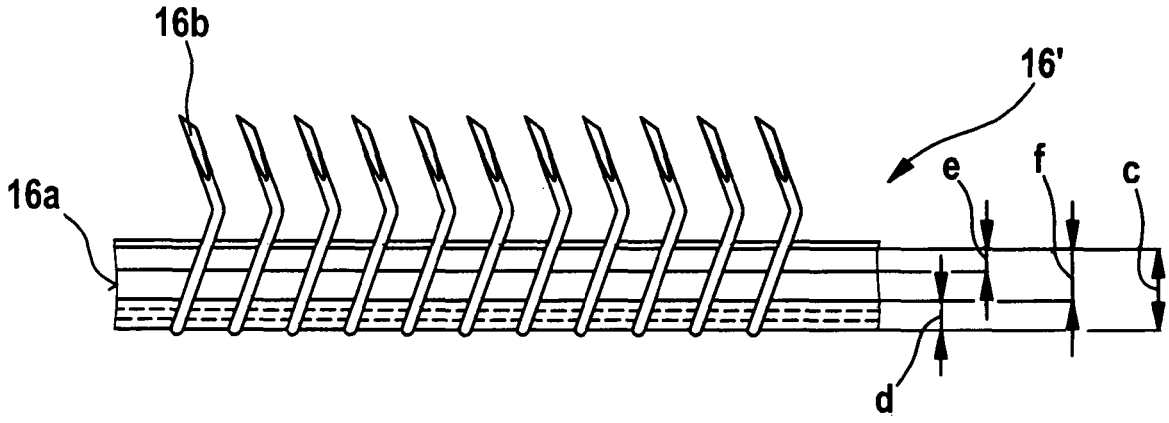
FIGS. 4*a*, 4*b* are a longitudinal section (FIG. 4*a*) and a transverse section (FIG. 4*b*) through part of a clothing strip (clothing support and clothing)
Figure 4B:
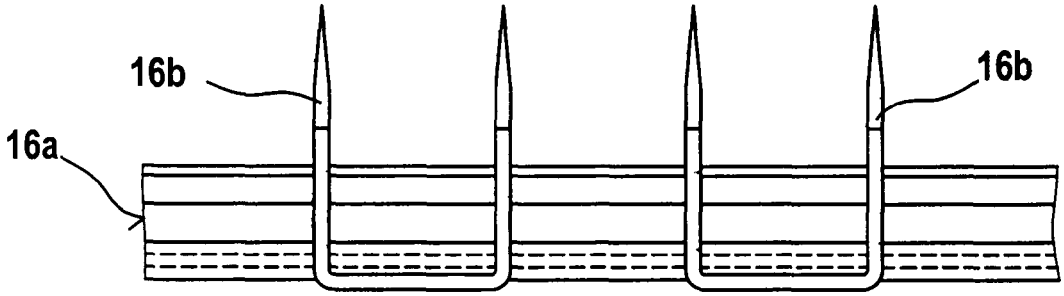
Figure 4C:
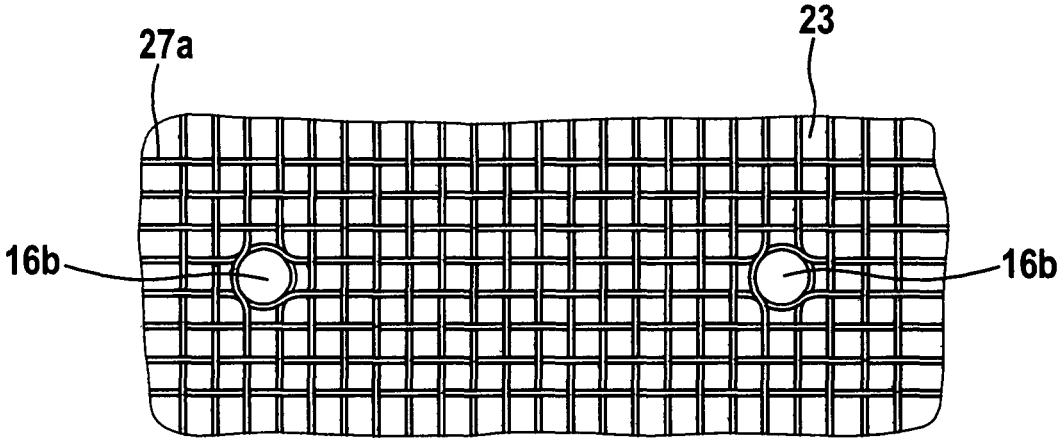
FIG. 4*c* is a top view of part of a reinforcing fabric with clothing wires held in mesh interstices.

FIGS. 4*a*, 4*b* show a clothing strip 16' incorporating a clothing support according to the invention. In the clothing support 16*a* a large number of clothing wires 16*b* are inserted and anchored. The clothing wires 16*b* pass through the entire clothing support 16*a* from the rear side, the free ends (tips) projecting out from the top coating layer 26. The clothing wires 16*b* are held in the mesh interstices of the reinforcing fabrics 27*a*, 27*b* (see FIG. 4*c*).

Figure 5:
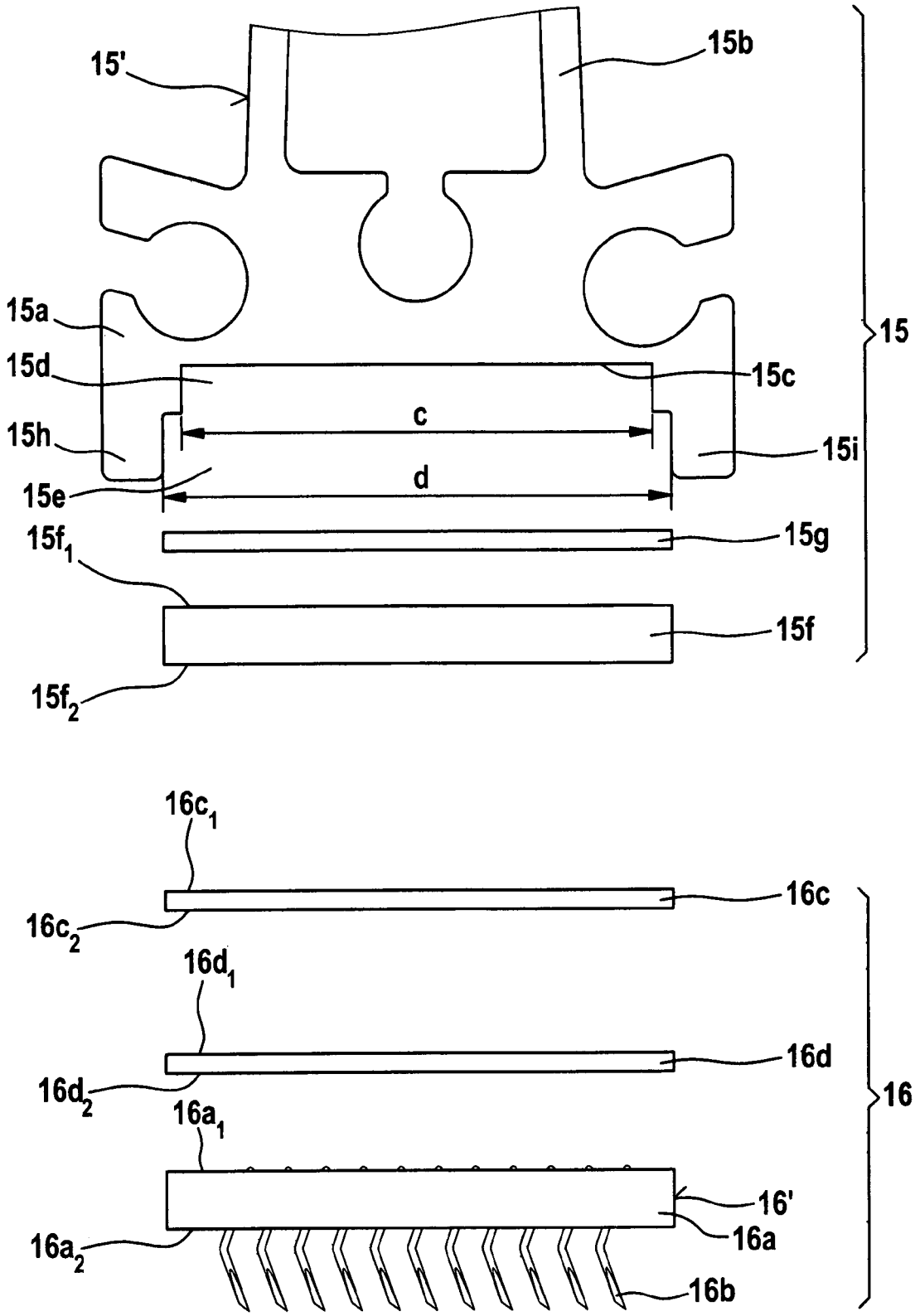
FIG. 5 is an exploded view of a card flat, consisting of a card flat carrier body and a clothing strip.

FIG. 5 shows an exploded view of a card flat including a clothing support according to the invention. The card flat 14 consists of a card flat carrier member 15 and a clothing element 16. The clothing element 16 is releasably (reversibly) fixed to the card flat carrier member 15. The card flat carrier member 15 comprises a profiled card flat member 15', which consists of a card flat foot 15*a* and a card flat back 15*b*. At each of the two ends of the elongate profiled card flat member 15', for example made of extruded aluminium, compression-moulded plastics material or the like, there is provided a card flat head, each of which—in the embodiment according to FIG. 2—comprises two card flat pins 15* and 15. On the card flat foot 15***a*, on the side facing away from the flats 15*b*, there are arranged two arms 15*h*, 15*i* in the longitudinal direction so that a two-stage recess 15*d*, 15*e* is present in the region of the card foot surface 15*c*. The card flat carrier member 15 also comprises a magnet element 15*f*, for example a magnet band, magnet strip or magnet bar or the like, which is fixed, by its top surface $\mathbf{15}f_1$, to the card foot surface 15*c* in the upper recess 15*d* by means of an adhesive layer 15*g*. The length of the card flat carrier member (seen over the width of the cylinder 4) is, for example, 1 m.

The clothing element 16 comprises a clothing strip 16', which consists of a strip-shaped clothing support 16*a* (clothing carrier element) of plastics material and the card flat clothing 16*b*. The card flat clothing 16*b* consists of clothing tips (small wire hooks); the small wire hooks are approximately U-shaped and, having been pushed through the surface $\mathbf{16}a_1$, are fixed in the support 16*a*. The regions where the small wire hooks bend around project out from the surface $\mathbf{16}a_1$. The ends of the small wire hooks—the clothing tips—project out from the surface $\mathbf{16}a_2$ and are free. The small wire hooks are made of steel wire. The clothing element 16 also comprises a top element 16*c*, for example a sheet steel strip, a steel band or the like, the bottom surface $\mathbf{16}c_2$ of which is fixed to the top surface $\mathbf{16}a_1$ of the clothing support element 16*a* by way of a connecting intermediate layer 16*d*, for example an adhesive layer. (As will be apparent from FIG. 5, references to "top" in connection with the clothing support 16*a* in FIG. 5 are to the bottom of the strip as shown in FIGS. 3, 4*a* and 4*b*, the strip having been inverted in FIG. 5). $\mathbf{16}d_1$ denotes the top surface of the intermediate layer 16*d*, and $\mathbf{16}d_2$ the bottom surface. The clothing element 16, with its parts the clothing strip 16', the intermediate layer 16*d* and the top element 16*c*, is fixed in the recess 15*e* so that only the card flat clothing 16*b* projects out beyond the bottom surface of the card flat foot 15*a*. Fixing is accomplished in such a manner that the top surface $\mathbf{16}c_1$ of the top element 16*c* (steel strip) is in area-wise contact with the bottom surface $\mathbf{15}f_2$ of the magnet element 15*f* (mounting plane). The positive connection between the card flat carrier member 15 and clothing element 16 is fixed in operation. The carding forces acting on the card flat clothing 16*b* are taken up and compensated by the arms 15*h*, 15*i* in the card flat foot 15*a*. The clothing strip 16' may be as described with reference to FIGS. 3 and 4*a* to 4*c*, or any other clothing strip according to the invention.

A nonwoven is understood herein especially according to the definition of, for example, DIN 61 210 as a flexible fabric produced by the bonding of fibrous webs. Fibrous webs are textile fabric arrangements made of textile fibres held together, generally, by the fibres' own adhesion. The fibrous webs can, however, also comprise threads or fabric arrangements for the purpose of reinforcement.

Whilst the exemplary embodiments of FIGS. 3, 4*a* to 4*c* and 5 may be used on a flat card of the kind illustrated in FIGS. 1 and 2, it will be appreciated that the carding support of the invention may be used in other cards.

Although the foregoing invention has been described in detail by way of illustration and example for purposes of understanding, it will be obvious that changes and modifications may be practised within the scope of the appended claims.

What is claimed is:

1. A clothing strip for a card flat covering, comprising at least:

a belt-shaped clothing support having a front surface and a back surface; and clothing wires inserted and anchored in the clothing support, the clothing wires having free ends protruding from the front surface of the clothing support;

wherein the clothing support comprises:

a first elongate layer adjacent the back surface, said first elongate layer consisting essentially of a first plastic material and a nonwoven fabric insert located within the first plastic material, a second elongate layer adjacent the front surface, the second elongate layer consisting essentially of a second plastic material different from the first plastic material, the second plastic material having a thickness of 0.1 to 0.3 mm and a Shore A hardness between 50 and 70, and a middle elongate layer directly adjacent to the first elongate layer and the second elongate layer, the middle elongate layer consisting essentially of a thermoplastic material having a thickness of 0.6 to 1.0 mm and a Shore A hardness between 50 and 70.

2. A clothing strip according to claim 1, in which the nonwoven fabric insert is consolidated.

3. A clothing strip according to claim 2, in which the nonwoven fabric insert is consolidated by through-stitching, adhesively, by heat treatment, or by needling.

4. A clothing strip according to claim 1, in which the second plastic material is polyurethane.

5. A clothing strip according to claim 1, wherein the middle layer consists essentially of polyvinyl chloride.

6. A clothing strip according to claim 1, in which the nonwoven fabric insert comprises two fabrics.

7. A clothing strip according to claim 1, wherein the nonwoven fabric insert comprises fibres having a linear density between 10 dtex and 1100 dtex.

8. A clothing strip according to claim 1, wherein the nonwoven fabric insert comprises a filament fabric, a woven fabric or a knit.

9. A clothing strip according to claim 1, in which the clothing support has a thickness of about 3.0 to 3.4 mm.

10. A clothing strip according to claim 1, in which the clothing support has a thickness of less than 3.0 mm.

11. A clothing strip according to claim 1, further comprising a top element arranged on the back surface of the support, the top element adapted to attach the clothing strip to a card flat body, the top element consisting of a metal sheet strip.

12. A card flat having a card flat covering including:

a belt-shaped clothing support having a front surface and a back surface; and clothing wires inserted and anchored in the clothing support, the clothing wires having free ends protruding from the front surface of the clothing support;

wherein the clothing support comprises:

a first elongate layer adjacent the back surface, said first elongate layer consisting essentially of a first plastic material and a nonwoven fabric insert located within the first plastic material, a second elongate layer adjacent the front surface, the second elongate layer consisting essentially of a second plastic material different from the first plastic material, the second plastic material having a thickness of 0.1 to 0.3 mm and a Shore A hardness between 50 and 70, and a middle elongate layer directly adjacent to the first elongate layer and the second elongate layer, the middle elongate layer consisting essentially of a thermoplastic material having a thickness of 0.6 to 1.0 mm and a Shore A hardness between 50 and 70.

* * * * *